US010987919B2

(12) United States Patent
Muro et al.

(10) Patent No.: US 10,987,919 B2
(45) Date of Patent: Apr. 27, 2021

(54) RECORDING APPARATUS AND RECORDING METHOD

(71) Applicant: CANON KABUSHIKI KAISHA, Tokyo (JP)

(72) Inventors: Kentaro Muro, Tokyo (JP); Masashi Hayashi, Yokohama (JP); Eiji Komamiya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/549,889

(22) Filed: Aug. 23, 2019

(65) Prior Publication Data

US 2020/0070502 A1 Mar. 5, 2020

(30) Foreign Application Priority Data

Aug. 31, 2018 (JP) ..... JP2018-163659

(51) Int. Cl.

| | |
|---|---|
| ***B41J 2/045*** | (2006.01) |
| ***B41J 19/20*** | (2006.01) |
| *B41J 11/00* | (2006.01) |
| *B41J 11/42* | (2006.01) |

(52) U.S. Cl.

CPC ..... *B41J 2/04508* (2013.01); *B41J 2/0458* (2013.01); *B41J 19/202* (2013.01); *B41J 11/002* (2013.01); *B41J 11/425* (2013.01); *B41J 2202/21* (2013.01)

(58) Field of Classification Search

CPC .. B41J 2/04508; B41J 2/0458; B41J 2202/21; B41J 19/202; B41J 11/002; B41J 11/425

See application file for complete search history.

(56) References Cited

U.S. PATENT DOCUMENTS

2015/0003883 A1* 1/2015 Honda ..... G03G 15/6529 399/406

FOREIGN PATENT DOCUMENTS

| | | | | |
|---|---|---|---|---|
| JP | 2005-224955 A | | 8/2005 | |
| JP | 2005224955 A | * | 8/2005 | ..... B41J 2/01 |
| JP | 2017-217823 A | | 12/2017 | |
| JP | 2017217823 A | * | 12/2017 | ..... B41J 2/01 |

* cited by examiner

*Primary Examiner* — Yaovi M Ameh

(74) *Attorney, Agent, or Firm* — Canon U.S.A., Inc., IP Division

(57) ABSTRACT

A recording apparatus is provided for determining a relative moving speed between a recording head and a recording medium based on application amount information and power information corresponding to power for driving a heating element. In a case of the power amount in a first amount, the moving speed is determined as a first speed in a case where an application amount is equal to a predetermined amount, and the moving speed is determined as a speed higher than the first speed in a case where the application amount is smaller than the predetermined amount. In a case of the power amount in a second amount smaller than the first amount, the moving speed is determined as a speed higher than the first speed in a case where the application amount is equal to the predetermined amount.

12 Claims, 11 Drawing Sheets

FIG.8

| RECORDING MEDIUM WIDTH L | | SH START POSITION | | SH END POSITION | | NUMBER OF SHS TO BE HEATED | |
|---|---|---|---|---|---|---|---|
| WIDTH LABEL | PIXEL RANGE [px] | HB | SH | HB | SH | COLOR | MONOCHROME |
| W1 | L > 6700 | HB0 | a | HB14 | e | 300 | 75 |
| W2 | 6700 ≥ L > 5700 | HB0 | e | HB14 | a | 268 | 67 |
| W3 | 5700 ≥ L > 4700 | HB1 | e | HB13 | a | 228 | 57 |
| W4 | 4700 ≥ L > 3700 | HB2 | e | HB12 | a | 188 | 47 |
| W5 | 3700 ≥ L | HB3 | e | HB11 | a | 148 | 37 |

FIG.9

| MONOCHROME/ COLOR | RECORDING MEDIUM WIDTH L [px] | THRESHOLD VALUE | | |
|---|---|---|---|---|
| | | 600 mm/s | 300 mm/s | 100 mm/s |
| COLOR | L > 6700 | 22 | 39 | — |
| | 6700 ≥ L > 5700 | 25 | 45 | — |
| | 5700 ≥ L > 4700 | 30 | 53 | — |
| | 4700 ≥ L > 3700 | 37 | 64 | — |
| | 3700 ≥ L | 47 | 83 | — |
| MONOCHROME | L > 6700 | 40 | 70 | — |
| | 6700 ≥ L > 5700 | 45 | 81 | — |
| | 5700 ≥ L > 4700 | 54 | 95 | — |
| | 4700 ≥ L > 3700 | 67 | 115 | — |
| | 3700 ≥ L | 85 | 149 | — |

RECORDING APPARATUS AND RECORDING METHOD

BACKGROUND

Field

The present disclosure relates to a recording apparatus and a recording method.

Description of the Related Art

An ink-jet recording apparatus is known to record an image using a recording head having substrates provided with a plurality of recording elements for generating thermal energy for discharging ink.

Japanese Patent Application Laid-Open No. 2017-217823 discusses a technique for heating ink using sub-heaters as heating units, different from recording elements, for heating the vicinity of the recording elements during recording.

Meanwhile, since power that can used by a recording head is limited, the total number of ink droplets which can be discharged per unit time is limited. Japanese Patent Application Laid-Open No. 2005-224955 discusses an apparatus for analyzing recording data and reducing a scanning speed of a recording head to restrain the number of dots to be recorded per unit time, if the number of dots to be recorded exceeds a threshold value.

However, the method discussed in Japanese Patent Application Laid-Open No. 2005-224955 does not take into consideration the power for driving sub-heaters during recording. When the sub-heaters are to be driven during recording, it is necessary to set a threshold value in consideration of the power for driving the sub-heaters. However, if this threshold value is constant regardless of a recording condition, lower power for driving the sub-heaters may lower the recording speed, possibly resulting in throughput being deteriorated.

SUMMARY

According to an aspect of the present disclosure, a recording apparatus includes a recording head provided with a discharge port disposed on a substrate and configured to discharge ink, a recording element disposed corresponding to the discharge port and configured to generate energy for discharging ink using power, and a heating element disposed on the substrate as a different member from the recording element and configured to heat the substrate using power to adjust a temperature of ink before being discharged, an acquisition unit configured to acquire application amount information about an application amount of ink to be applied to a predetermined region on the recording medium based on data of an image to be recorded on a recording medium, a movement unit configured to relatively move the recording head and the recording medium in a predetermined direction, and a determination unit configured to determine a moving speed for relatively moving the recording head and the recording medium based on the application amount information. The recording head discharges ink onto the recording medium to record the image, while the movement unit is relatively moving the recording head and the recording medium at the speed determined by the determination unit. Based on power information corresponding to power amount used for driving the heating element, in a case of the power amount in a first amount the determination unit determines, a first speed for the moving speed in a case where the application amount is equal to a predetermined amount and determines a speed higher than the first speed for the moving speed in a case where the application amount is smaller than the predetermined amount, and, in a case of the power amount in a second amount smaller than the first amount, the determination unit determines a speed higher than the first speed for the moving speed in a case where the application amount is equal to the predetermined amount.

Further features will become apparent from the following description of exemplary embodiments with reference to the attached drawings.

BRIEF DESCRIPTION OF THE DRAWINGS

FIG. 8 illustrates a heating region determination table according to the present exemplary embodiment.

FIG. 9 illustrates a speed determination table according to the present exemplary embodiment.

DESCRIPTION OF THE EMBODIMENTS

Exemplary embodiments will be described below with reference to the accompanying drawings.

<Configuration of Ink-Jet Recording Apparatus>

Figure 1:
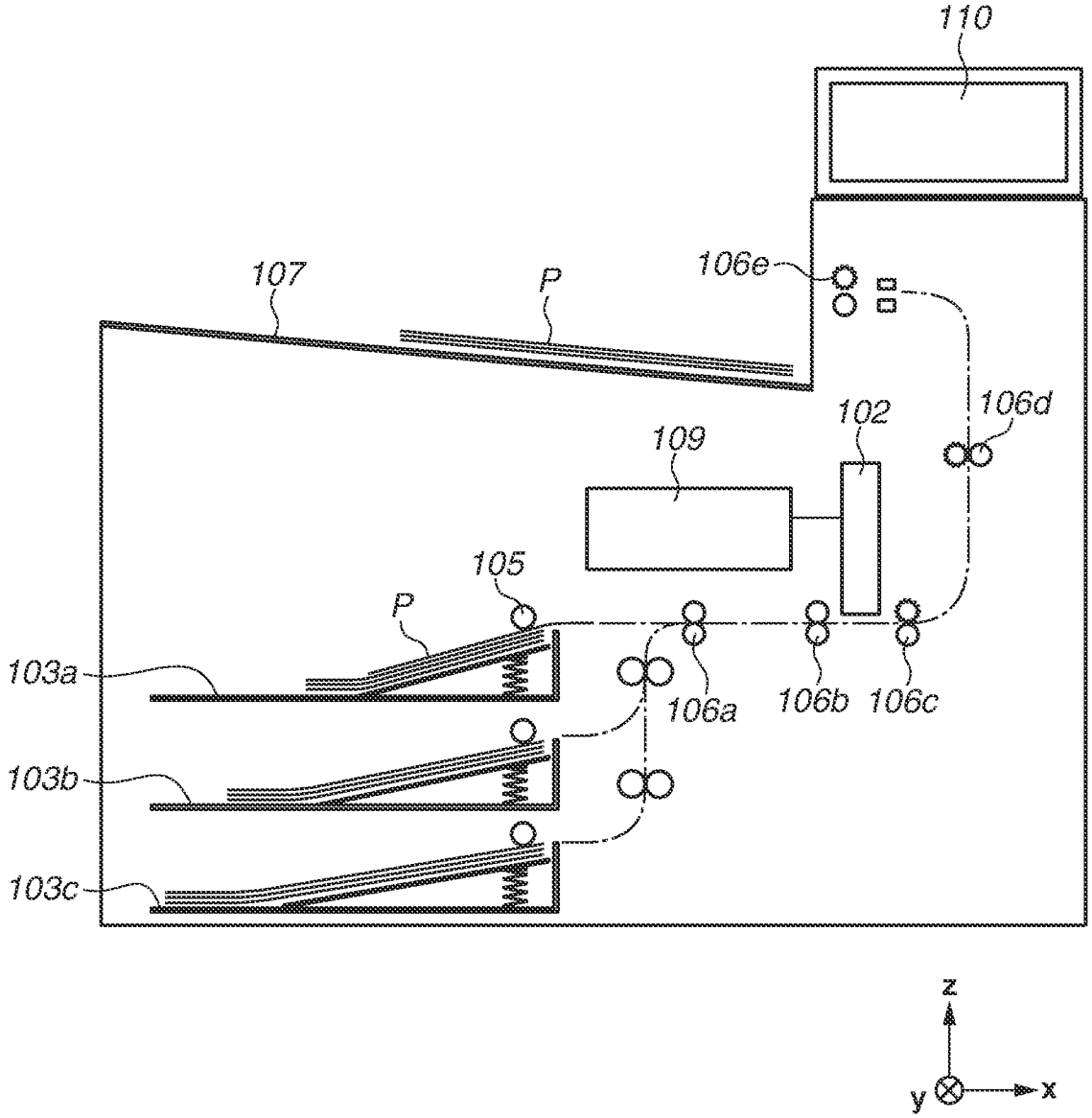
FIG. 1 is a cross-sectional view illustrating a recording apparatus according to the present exemplary embodiment.

FIG. 1 illustrates an internal configuration of an ink-jet recording apparatus (hereinafter also referred to as a recording apparatus) according to the present exemplary embodiment. Recording media P can be stacked on feeding units 103*a*, 103*b*, and 103*c*, which can be loaded with recording media P having different sizes. A recording medium P is fed from any one of the feeding units 103*a*, 103*b*, and 103*c*, and then nipped and conveyed by conveyance roller pairs 106*a* to 106*e* along a dash-dotted line illustrated in FIG. 1.

The recording medium P fed from any one of the feeding units 103*a* to 103*c* is first conveyed to a position facing a recording head 102 by the conveyance roller pairs 106*a* to 106*c*. The recording head 102 is provided with discharge port arrays in which discharge ports for discharging ink are disposed in a Y direction, on a surface facing the recording medium P. A control unit 109 controls entire recording operations. The recording head 102 and the control unit 109 will be described in detail below. Based on recording data transmitted from the control unit 109, the recording head 102 discharges ink from the discharge ports onto the conveyed recording medium P to form an image thereon. Image recording is performed while the recording medium P is being conveyed in a −X direction (predetermined direction).

When recording is completed, the recording medium P is discharged onto a discharge unit 107.

An operation unit 110 is a display that enables a touch input operation. A user makes various settings from the operation unit 110, and the operation unit 110 notifies the user of information such as remaining ink amount information. In addition to the display, the operation unit 110 can include hardware keys and a sound device enabling audio input and audio generation.

According to the present exemplary embodiment, a conveyance speed of the recording medium P while the recording head 102 is discharging ink onto the recording medium P is referred to as a recording speed (moving speed). In the recording apparatus, recording can be performed while the recording head 102 and the recording medium P are relatively moving. Recording can be performed on the recording medium P while the recording head 102 is moving. In this case, the speed at which the recording head 102 scans the recording medium P is referred to as the recording speed.

<Recording Head>

Figure 2:
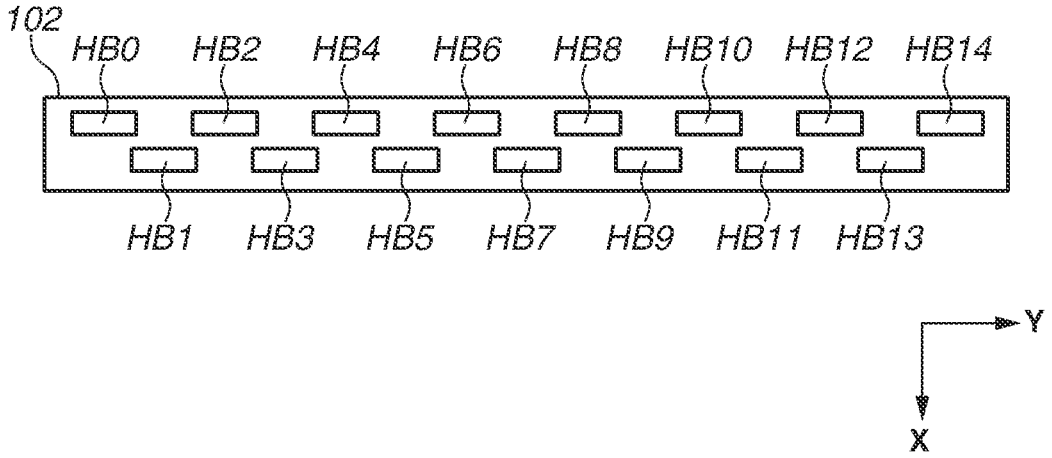
FIG. 2 illustrates an entire configuration of a recording head according to the present exemplary embodiment.

FIG. 2 illustrates a configuration of the recording head 102 according to the present exemplary embodiment. Referring to FIG. 2, the recording head 102 is provided with a total of 15 heater boards (recording element substrates) HB0 to HB14. On each heater board, discharge ports are disposed in the Y direction (intersecting direction) to form a plurality of discharge port arrays disposed in the X direction. This arrangement will be described in detail below. The heater boards are disposed in a discharge port array direction (Y direction) so that ends of discharge port arrays of each heater board partially overlap with ends of discharge port arrays of other heater boards in the X direction. A width of the discharge ports in the Y direction is equal to or larger than a maximum possible width of the recording medium P in the Y direction. The recording medium P is conveyed in the X direction. By using the recording head 102 in which the 15 heater boards HB0 to HB14 are disposed in the Y direction in this way, recording can be performed over an entire area of the recording medium P having a long width in the discharge port array direction. Instead of being composed of a plurality of heater boards, the recording head 102 can be composed of one heater board having long discharge port arrays extending in the Y direction.

Figure 3:
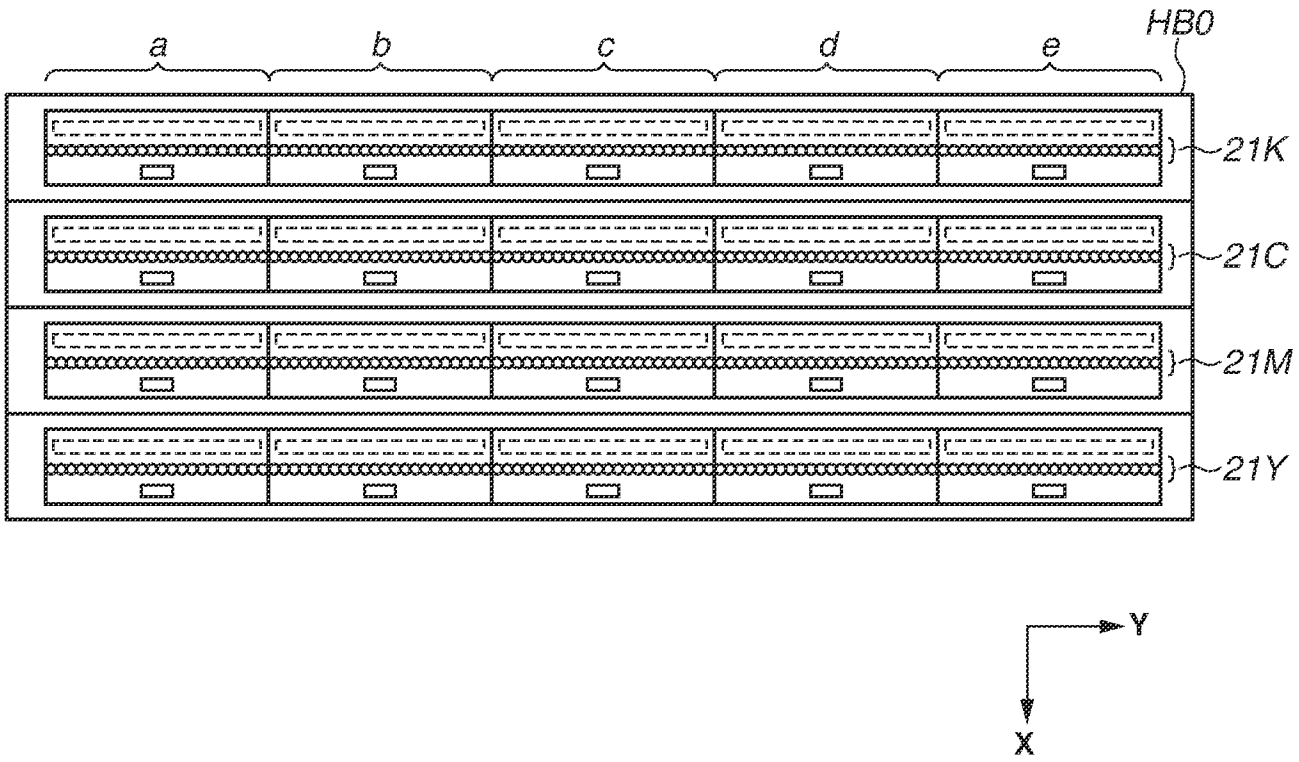
FIG. 3 illustrates an entire configuration of a heater board according to the present exemplary embodiment.

FIG. 3 illustrates a configuration of the heater board HB0 out of the heater boards HB0 to HB14. Although only the heater board HB0 will be described below, other heater boards HB1 to HB14 have the same configuration as the heater board HB0.

Referring to FIG. 3, the heater board HB0 is provided with four discharge port arrays 21K, 21C, 21M, and 21Y. Each discharge port array includes a plurality of discharge ports for discharging black (K), cyan (C), magenta (M), and yellow (Y) ink disposed in the Y direction.

Figure 4:
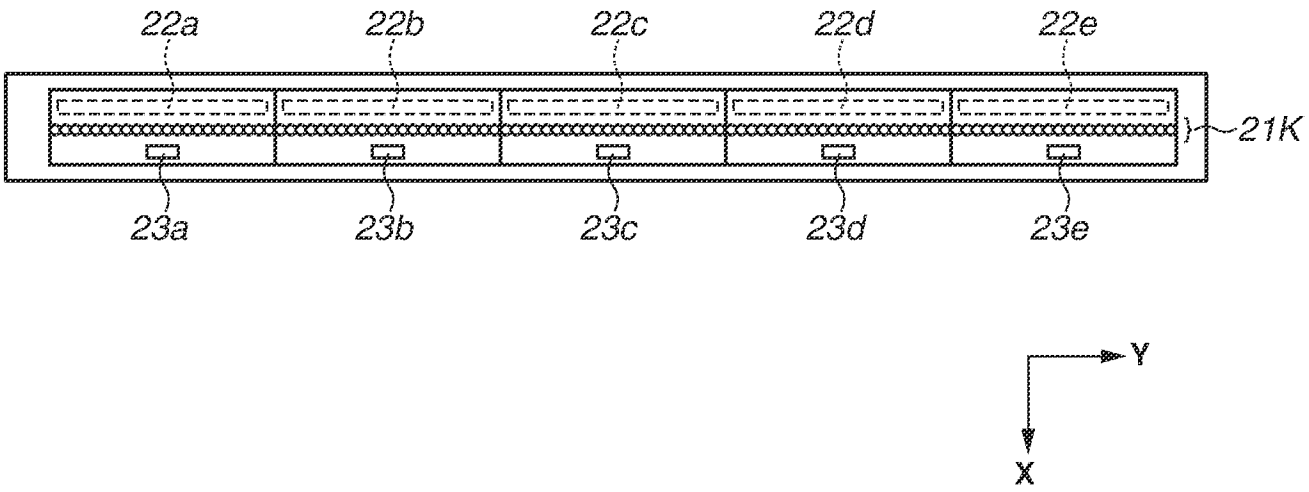
FIG. 4 is a partial enlarged view illustrating the heater board according to the present exemplary embodiment.

FIG. 4 is an enlarged view illustrating the discharge port array 21K for one color (black) and the periphery thereof. Referring to FIG. 4, each discharge port of the discharge port array 21K is provided with a recording element (not illustrated) at a corresponding position. This recording element is an electric heat conversion element driven by a head control unit 406 (described below). When applied with a drive pulse from the head control unit 406, the recording element is driven to generate thermal energy. When ink is foamed by the generated thermal energy, ink is discharged from each discharge port. The recording element needs to be an element for generating energy by using power. A piezoelectric element, an electrostatic element, and a Micro Electro Mechanical System (MEMS) element are applicable.

The discharge port array 21K includes sub-heaters (hereinafter also referred to as SHs) 22*a* to 22*e* as heating elements disposed in the −X direction (upstream side of the recording medium P in a conveyance direction) separately from the recording elements. The discharge port array 21K also includes temperature sensors 23*a* to 23*e* in a +X direction (downstream side of the recording medium P in the conveyance direction). When the sub-heaters 22 are applied with a voltage, the sub-heaters 22 generate heat to heat the substrate of the heater board HB0. Then, the heated substrate heats ink near the substrate to such an extent that ink is not discharged from the discharge ports. By heating ink using the sub-heaters 22 to adjust an ink temperature before driving the recording elements, ink can be efficiently discharged when the recording elements are driven. The sub-heaters 22 are made of a simple substance or alloy of aluminum or other metals, and a resistance value of the sub-heaters 22 varies with temperature. The sub-heaters 22 can be formed of a single layer or a plurality of layers. The temperature sensors 23 are sensors for detecting a temperature near the recording elements in the heater board HB0. According to the present exemplary embodiment, the ink temperature is adjusted to a desired temperature by controlling an application of the drive pulse to the sub-heaters 22 based on the temperature detected by the temperature sensors 23 during and before recording.

<Recording Control>

Figure 5:
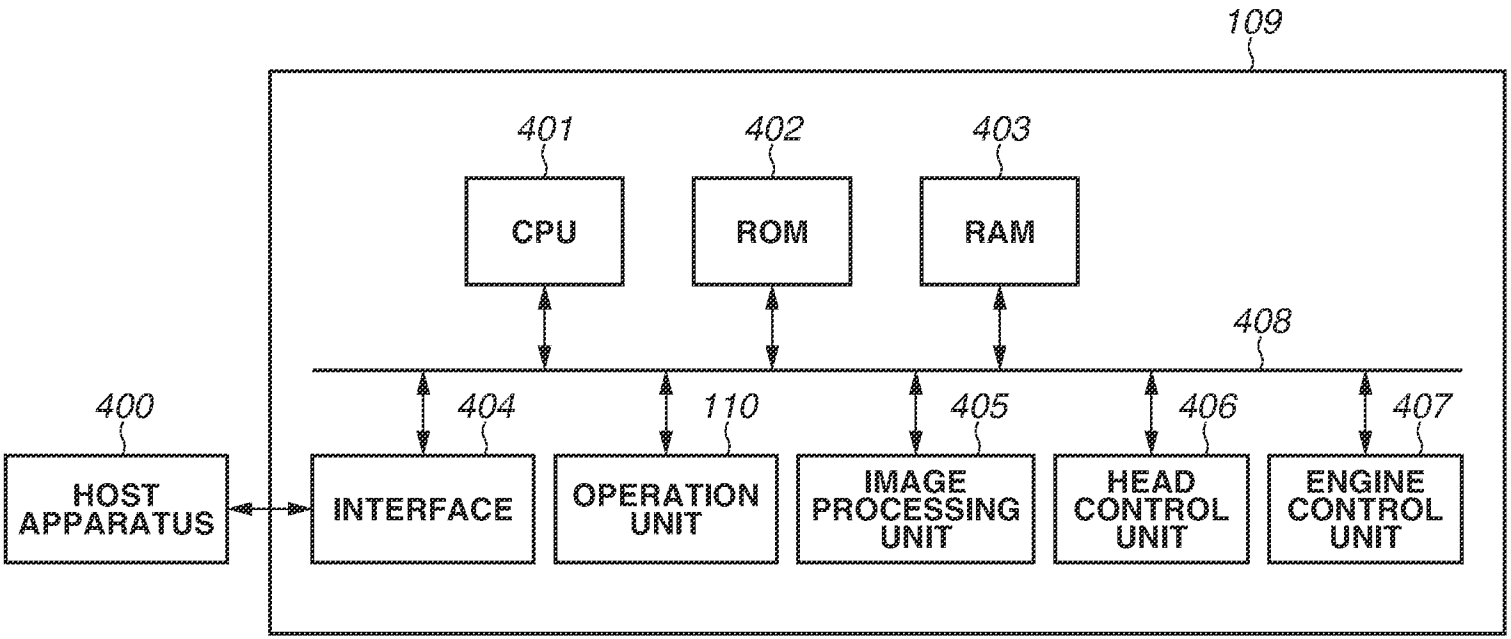
FIG. 5 is a block diagram illustrating the recording apparatus according to the present exemplary embodiment.

FIG. 5 illustrates a configuration of a recording control system in the recording apparatus according to the present exemplary embodiment. The control unit 109 includes a central processing unit (CPU) 401, a read only memory (ROM) 402, a random access memory (RAM) 403, an interface 404, an image processing unit 405, the head control unit 406, an engine control unit 407, and the operation unit 110. The CPU 401 totally controls an operation of each unit of the recording apparatus. The ROM 402 stores programs to be executed by the CPU 401 and fixed data required for various operations of the recording apparatus. The RAM 403 is used as a work area for the CPU 401 and a temporary storage area for various receive data, and is also used to store various setting data. The operation unit 110 is a display which enables touch input operations. The user makes various settings from the operation unit 110, and the operation unit 110 notifies the user of information such as remaining ink amount information.

Image processing requiring high-speed data processing is performed by the image processing unit 405 as a dedicated processing unit. The image processing unit 405 performs image processing on image data to be recorded by the recording apparatus. The image processing unit 405 converts a color space (for example, YCbCr) of image data input from a host apparatus 400 into a standard red, green, and blue (RGB) color space (for example, sRGB). Image data is subjected to various image processing including resolution conversion, image analysis, and image correction. These pieces of image processing generate recording data recordable by the recording head 102. The recording data is stored in the RAM 403.

The CPU 401 determines the sub-heaters to be heated out of the sub-heaters 22*a* to 22*e*. The head control unit 406 heats the sub-heaters 22 based on determination by the CPU 401.

Based on a recording instruction from the CPU 401, the head control unit 406 reads the recording data stored in the RAM 403. When the head control unit 406 generates a discharge signal based on the recording data, the recording elements of the recording head 102 are driven by the discharge signal. When the recording elements are driven to discharge ink, an image is formed on the recording medium P. The sub-heaters 22 are driven even during recording performed by the recording head 102.

The engine control unit 407 controls a conveyance mechanism of each unit in the recording apparatus, paper feeding operations, and the discharge unit 107. The engine control unit 407 controls the operation of each unit based on an instruction from the CPU 401. The interface 404 is a unit for communicably connecting the control unit 109 and the host apparatus 400, and serves as a local or network interface. The above-described components are connected with each other via a system bus 408.

The host apparatus 400 is an apparatus for supplying image data subjected to recording by the recording apparatus. The host apparatus 400 can be a general-purpose or dedicated computer, or a dedicated image apparatus such as an image capture with an image reader, a digital camera, and a photo storage. When the host apparatus 400 is a computer, an operating system (OS), application software for generating image data, and printer drivers for printing apparatuses are installed in a storage device included in the computer. All of the above-described processing can be implemented by software. Alternatively, part or whole of the processing can be implemented by hardware.

Figure 6:
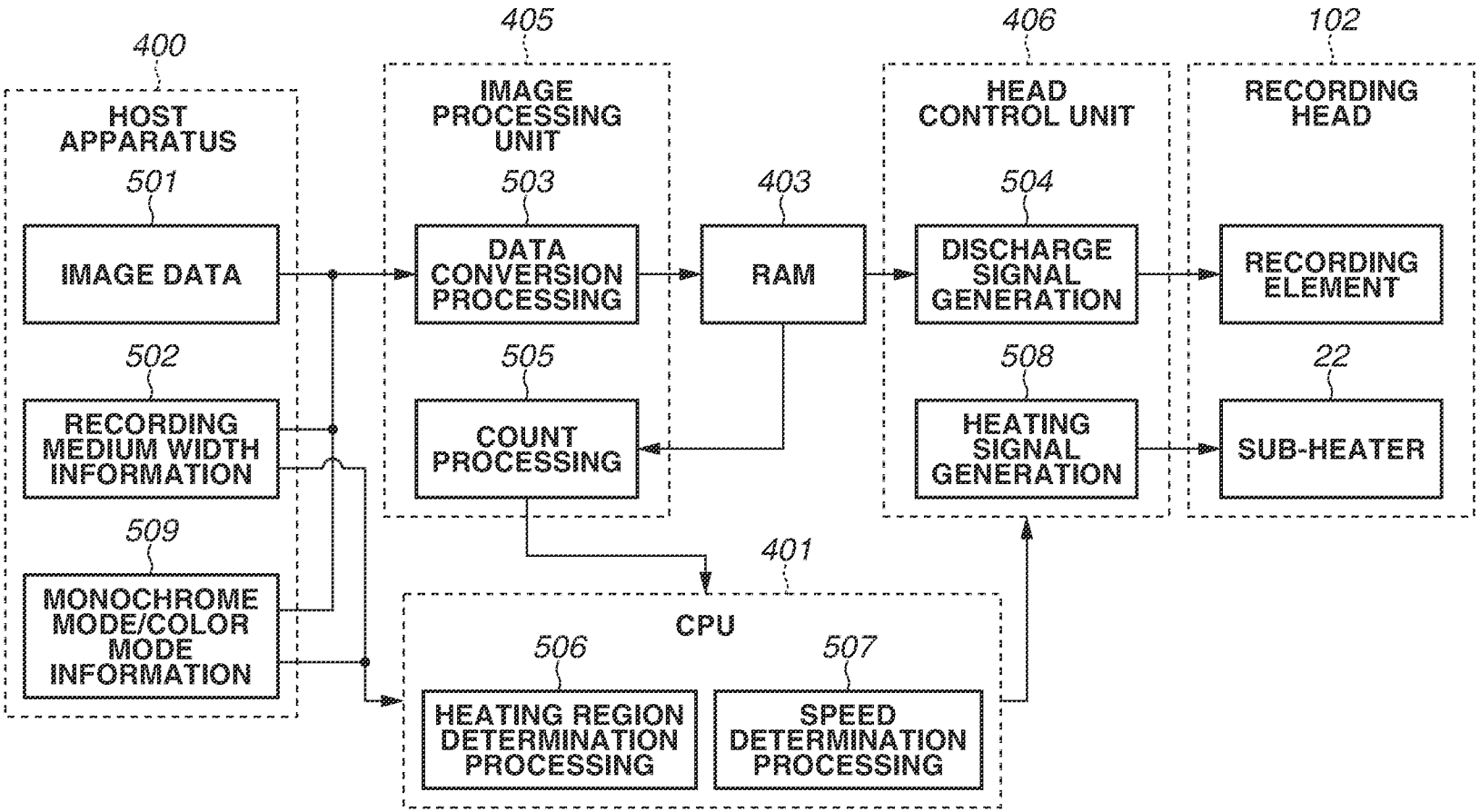
FIG. 6 is a flowchart illustrating a flow of processing using input image data and various information according to the present exemplary embodiment.

FIG. 6 is a flowchart illustrating a flow of processing using input image data and various input information, together with components for performing each piece of processing. Image data 501 in the host apparatus 400 is input to the image processing unit 405. Data conversion processing 503 performed in the image processing unit 405 converts the image data 501 as multivalued data such as RGB data into binary recording data indicating discharge and non-discharge of ink droplets from the recording head 102 for each pixel. Multivalued data is also applicable when discharged ink droplets have variable sizes. Binary recording data is stored in the RAM 403. At the time of recording, the head control unit 406 reads the binary recording data from the RAM 403. The head control unit 406 generates a discharge signal via discharge signal generation 504 based on the read recording data, and outputs the discharge signal to the recording head 102. The discharge signal drives the recording elements of the recording head 102 to discharge ink.

Count processing 505 is processing for acquiring application amount information related to an ink application amount. The count processing 505 counts the number of ink droplets to be discharged to one page on one side of the recording medium P based on the binary recording data read from the RAM 403. In this case, a predetermined region is one page on one side. In a case where the recording head 102 can discharge large droplets having a large discharge amount and small droplets having a small discharge amount, the count processing 505 can count the number of ink droplets by multiplying the number of ink droplets by different coefficients depending on the size of ink droplets. According to the present exemplary embodiment, the count processing 505 counts only the number of K ink droplets in a monochrome mode, or the total number of K, C, M, and Y ink droplets in a color mode. Applicable modes include not only the monochrome and the color modes but also a mode for performing recording only in CMY colors and a mode for performing recording in two colors. Hereinafter, the counted number of ink droplets to be discharged to one page on one side is also referred to as a dot count. The count processing 505 calculates recording density as the application amount information based on the counted dot count, and uses the recording density for processing to be described below. Hereinafter, an area of one pixel according to the present exemplary embodiment is assumed to be 1/600 by 1/600 inches (X direction by Y direction). The recording density [%] is obtained by dividing the total dot count by the pixel area and multiplying the quotient by 100. For example, in a case of an A4-size recording medium with 4,960 by 7,016 pixels (X direction by Y direction), the recording density [%]=Total dot count/(4,960*7,016)*100.

The CPU 401 performs heating region determination processing 506 and speed determination processing 507 based on recording medium P width information 502 and monochrome mode/color mode information 509 acquired from the host apparatus 400, and on the recording density obtained in the count processing 505. According to the present exemplary embodiment, the voltage applied to the sub-heaters 22 is constant. Therefore, the power used to heat the sub-heaters 22 is determined by the number of sub-heaters to be heated. The CPU 401 determines a region of the sub-heaters to be heated based on the width of the recording medium P via the heating region determination processing 506, and determines a recording speed through the speed determination processing 507. The heating region determination processing 506 and the speed determination processing 507 will be described in detail below. The recording medium P width information 502 is not limited to information about the width in the Y direction. If a size of the recording medium P, the standard including A4, and the width corresponding to the size are prestored in the ROM 402, for example, information about the size of the recording medium P can be used as the recording medium width information. For the monochrome mode/color mode information 509, when the user sets "Automatic" for the monochrome mode/color mode on the host apparatus 400, an image to be recorded may be unable to be distinguished as a monochrome or color image. In a case where the image is unable to be distinguished, the control unit 109 performs each piece of processing on the assumption that the color mode is selected.

The head control unit 406 generates, through the discharge signal generation 504, a discharge signal based on the recording data read from the RAM 403 and the recording speed determined by the speed determination processing 507, and drives the recording head 102. The head control unit 406 also generates, through the heating signal generation 508, a heating signal based on the sub-heater heating region determined by the heating region determination processing 506, and drives the sub-heaters 22. In this way, recording is performed while the sub-heaters 22 are being driven.

<Heating Region Determination Processing>

According to the present exemplary embodiment, the CPU 401 performs the heating region determination processing 506 based on the recording medium P width information 502 and the monochrome mode/color mode information 509 received from the host apparatus 400 to determine the heating region of the heater boards of the recording head 102. The heating region determination processing 506 will be described below with reference to FIGS. 7 and 8, and additionally with reference to FIG. 5.

Figure 7:
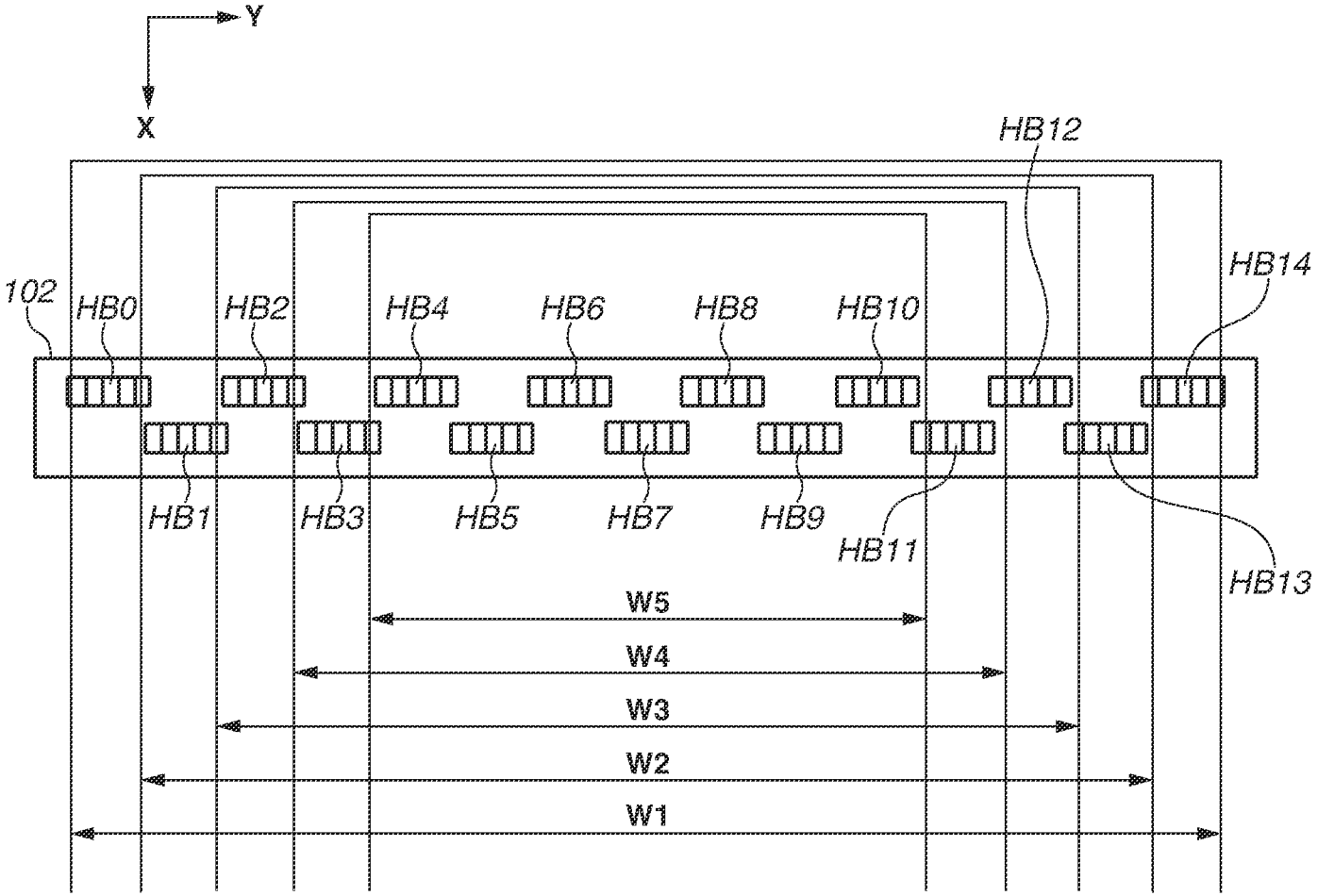
FIG. 7 illustrates a positional relation between a recording medium and heating regions according to the present exemplary embodiment.

FIG. 7 illustrates a positional relationship between the width of the recording medium P and the heating region. FIG. 7 illustrates five different widths of the recording medium P, W1 to W5. For the recording medium P having the width W3, for example, image recording is performed within a range between the sub-heater 22*e* of the heater board HB1 and the sub-heaters 22*a* of heater board HB13. (Each heater board is divided into five sub-heaters disposed in the Y direction. Details are illustrated in FIG. 4.)

FIG. 8 is a table defining the heating regions for different widths of the recording medium P (hereinafter referred to as a recording medium width L). The table shows the range of the number of pixels, the sub-heater heating region corresponding to the range, and the number of sub-heaters to be heated for each of widths W1 to W5. For example, an A4 size includes 4,960 pixels in the Y direction and has the width W3 (5700≥Y>4,700), and an A3 size includes 7,016 pixels in the Y direction and has the width W1 (Y>6700). The heating region is defined by the start and the end positions of the sub-heaters. The start and the end positions are indicated by the number of the sub-heater. For example, when the recording medium P has the width W3, the sub-heaters 22 ranging from the sub-heater 22*e* of the HB1 to the sub-heater 22*a* of the HB13 are heated, and the sub-heaters out of this range are not heated. The number of sub-heaters 22 to be heated is indicated in the table illustrated in FIG. 8. In the monochrome mode, the sub-heaters 22 of the discharge port array 21K for black color ink are turned ON. In the color mode, the sub-heaters 22 of the discharge port arrays 21K, 21C, 21M, and 21Y for all of the four colors are turned ON. Therefore, the number of sub-heaters to be heated in the color mode is four times the number of sub-heaters to be heated in the monochrome mode.

According to the present exemplary embodiment, the control unit 109 independently drives each sub-heater to adjust the temperature of the recording head 102. For example, when the recording medium P has the width W3, the HB1 heats only the sub-heater 22*e*. Since the heat generated by the sub-heater 22*e* of the HB1 is transmitted to non-heating portions in the HB1, the ink temperature of the HB1 becomes lower than the ink temperature of the HB2 to HB12. To prevent this, the heating region can also be determined to drive all of the sub-heaters of the heater boards covering the range of the recording medium P.

When a heater board includes sub-heaters to be heated and sub-heaters not to be heated, like the HB1, the target temperature can be achieved by more intensively heating the sub-heaters than the sub-heaters 22 of other heater boards such as the HB 2. In this case, threshold values are set in consideration of the additional power. Alternatively, a heating region can be determined to drive up to the sub-heaters at positions corresponding to regions out of the recording medium width.

<Speed Determination Processing>

The speed determination processing 507 for determining a recording speed based on three pieces of information: the recording density, the recording medium P width information 502, and the monochrome mode/color mode information 509.

FIG. 9 illustrates a speed determination table. FIG. 9 is a table defining upper limits (hereinafter referred to as threshold values) of recording densities recordable at the recording speeds supported by the recording apparatus (600, 300, and 100 mm/s according to the present exemplary embodiment). Conditions are classified as two categories (monochrome and color) each of which is divided into five groups by the recording medium width L. For the same mode (monochrome mode/color mode) and the same recording medium width L, the recording speed for higher recording densities is lower than the recording speed for lower recording densities.

The control unit 109 identifies applicable data in the speed determination table based on the recording medium P width information 502 and the monochrome mode/color mode information 509 received from the host apparatus 400. In this case, it is assumed that the received monochrome mode/color mode information 509 indicates the color mode and that the recording medium P width information 502 indicates 5700≥L>4700. When the control unit 109 acquires an image recording density obtained by the count processing 505 of the image processing unit 405, the control unit 109 compares the recording density with a first threshold value (30 as the threshold value in the column of the 600 mm/s recording speed) corresponding to the highest speed out of the threshold values corresponding to the recording medium width indicated by the previously received information. In a case where the recording density is equal to or lower than the first threshold value, the control unit 109 determines the recording speed as 600 mm/s. In a case where the recording density exceeds the first threshold value, the control unit 109 compares the recording density with a second threshold value (53 as the threshold value in the column of the 300 mm/s recording speed) as the second largest threshold value. In a case where the recording density is equal to or lower than the second threshold value, the control unit 109 determines the recording speed as 300 mm/s. In a case where the recording density exceeds the second threshold value, the control unit 109 determine the recording speed as 100 mm/s. Threshold values are not described (a hyphen "-" is described) for 100 mm/s because a recording operation is possible even with the maximum recording density. When there is a mode in which recording is not possible at a recording speed of 100 mm/s, or when a speed lower than 100 mm/s is set as a scanning speed, a threshold value can also be set in the column of the 100 mm/s recording speed.

Referring to the speed determination table, larger threshold values are set for smaller heating regions. The smaller the heating region, the wider the range of the recording density with which high speed recording is possible.

Although, in the present exemplary embodiment, the control unit 109 counts the dot count for one page on one side to obtain the recording density, the predetermined region subjected to counting is not limited thereto. For example, the recording density can be obtained by dividing one page on one side into a plurality of regions in the X direction, and counting the dot count for each division region. In this case, the control unit 109 sets threshold values according to the division region and determines the recording speed according to a position with the highest recording density out of the obtained recording densities.

Although, in the present exemplary embodiment, threshold values are set based on the recording medium P width information 502 and the monochrome mode/color mode information 509, threshold values can be set based on other conditions. For example, in order to achieve a desired ink temperature, the control unit 109 changes the voltage to be applied to the sub-heaters. The control unit 109 can set threshold values based on a magnitude of power consumption by the change of the applied voltage.

<Processing Flow>

Figure 10:
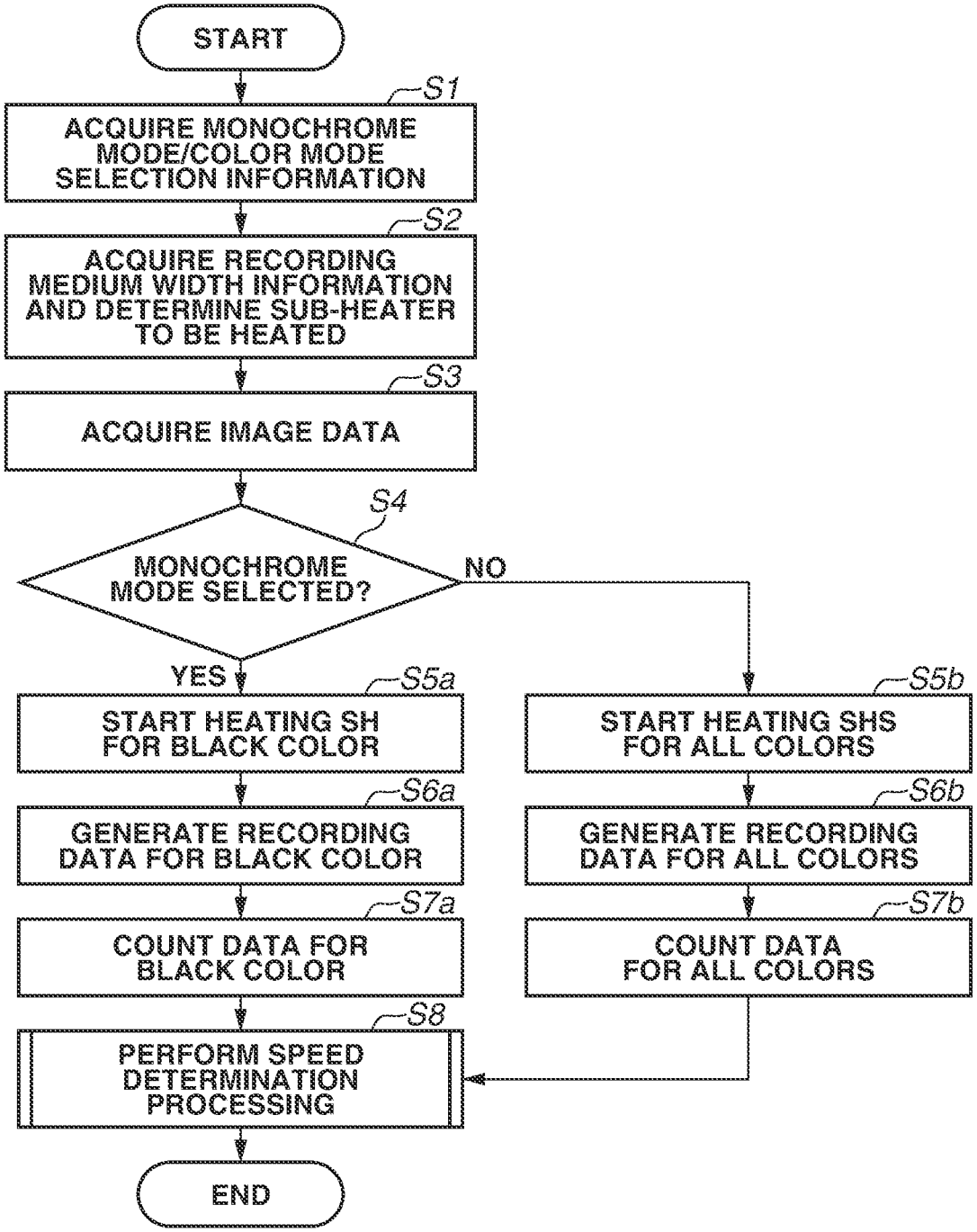
FIG. 10 is a flowchart illustrating processing according to the present exemplary embodiment.

FIG. 10 is a flowchart illustrating processing performed by the control unit 109 since the control unit 109 receives a recording instruction from the host apparatus 400 until it starts recording.

In step S1, the control unit 109 acquires the monochrome mode/color mode information 509 from the host apparatus 400. As described above, if the monochrome mode/color mode cannot be determined, the control unit 109 perform the following processing assuming the mode to be a color mode.

In step S2, the control unit 109 acquire the recording medium P width information 502 from the host apparatus 400 and performs the heating region determination processing 506 of the CPU 401 to determine the sub-heaters to be heated.

In step S3, the control unit 109 acquires image data from the host apparatus 400.

In step S4, the control unit 109 determines whether the information acquired in step S1 is monochrome mode information. In a case where the acquired information is monochrome mode information (YES in step S4), the processing proceeds to step S5*a*. On the other hand, in a case where the acquired information is color mode information (NO in step S4), the processing proceeds to step S5*b*.

In a case where the acquired information is monochrome mode information (YES in step S4), the processing proceeds to step S5*a*. In step S5*a*, the control unit 109 starts heating the sub-heaters corresponding to the discharge port array 21K for black color in the heating region determined in step S2.

In step S6*a*, the control unit 109 generates binary recording data based on the image data acquired in step S3, through the data conversion processing 503 of the image processing unit 405, and stores the recording data in the RAM 403. In step S7*a*, the control unit 109 obtains a recording density of the recording data stored in the RAM 403, through the count processing 505.

In a case where the acquired information is color mode information (NO in step S4), the processing proceeds to step S5*b*. In step S5*b*, the control unit 109 starts heating the sub-heaters corresponding to the discharge port array 21 for all colors in the heating region determined in step S2.

In step S6*b*, the control unit 109 generates binary recording data based on the image data acquired in step S3, through the data conversion processing 503 of the image processing unit 405, and stores the recording data in the RAM 403. In step S7*b*, the control unit 109 obtains a recording density of the recording data stored in the RAM 403, through the count processing 505.

In step S8, referring to the speed determination table, the control unit 109 determines a recording speed based on the recording medium P width information 502 obtained in step S2 and the recording density obtained in step S7*a* or S7*b*, through the speed determination processing 507 of the CPU 401. The processing will be described in detail below.

Upon completion of the processing illustrated in FIG. 10, the head control unit 406 controls the recording head 102 to start image recording on the recording medium P.

Figure 11:
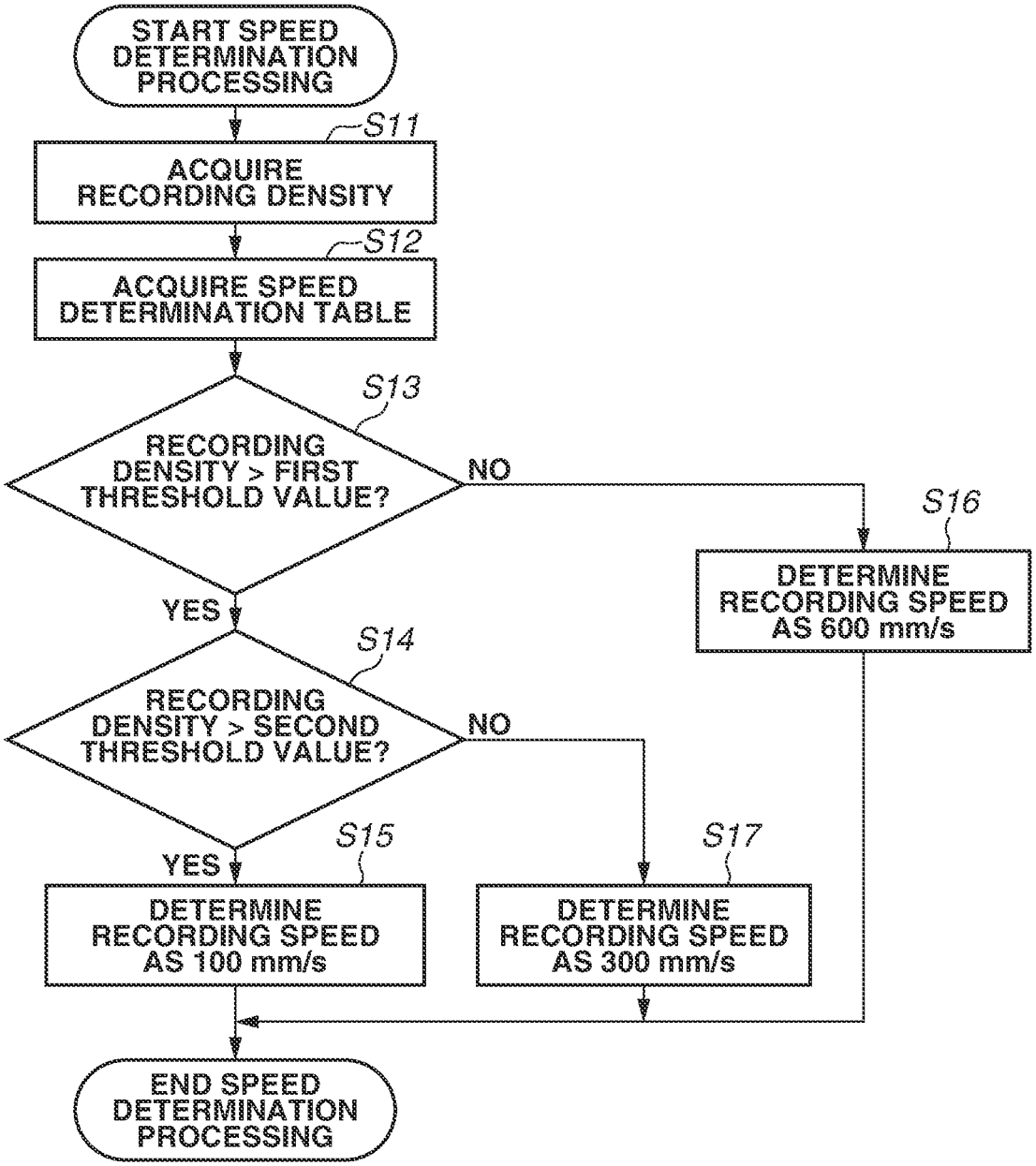
FIG. 11 is a flowchart illustrating speed determination processing according to the present exemplary embodiment.

FIG. 11 is a flowchart illustrating the speed determination processing 507. As described above, the speed determination processing 507 is performed by the CPU 401.

In step S11, the control unit 109 acquires the recording density through the count processing 505 of the image processing unit 405. In step S12, the control unit 109 reads the speed determination table (FIG. 9) from the ROM 402. In step S13, the control unit 109 compares the recording density with the first threshold value for the applicable condition in the speed determination table. In a case where the recording density is larger than the first threshold value (YES in step S13), the processing proceeds to step S14. On the other hand, in a case where the recording density is equal to or smaller than the first threshold value (NO in step S13), the processing proceeds to step S16. In step S16, the control unit 109 determines the recording speed as 600 mm/s and ends the speed determination processing.

In step S14, the control unit 109 compares the recording density with the second threshold value for the applicable condition in the speed determination table. In a case where the recording density is larger than the second threshold value (YES in step S14), the processing proceeds to step S15. On the other hand, in a case where the recording density is equal to or smaller than the second threshold value (NO in step S14), the processing proceeds to step S17. In step S17, the control unit 109 determines the recording speed as 300 mm/s and ends the speed determination processing.

In step S15, the control unit 109 determines the recording speed as 100 mm/s and ends the speed determination processing.

Although, in the present exemplary embodiment, the recording speed is changed according to the recording condition by changing the threshold values to be used, other methods are also applicable as long as the recording speed to be selected can be changed according to the recording condition. For example, maintaining constant threshold values, the recording density can be used as it is for the monochrome recording condition, and the recording density multiplied by a predetermined coefficient (1 or larger) can be used for the color recording condition.

Other Embodiments

Embodiment(s) can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-163659, filed Aug. 31, 2018, which is hereby incorporated by reference herein in its entirety.

What is claimed is:

1. A recording apparatus comprising:

a recording head including a discharge port disposed on a substrate and configured to discharge ink, a recording element disposed corresponding to the discharge port and configured to generate energy for discharging ink using power, and a heating element disposed on the substrate as a different member from the recording element and configured to heat the substrate using power to adjust a temperature of ink before being discharged;

an acquisition unit configured to acquire application amount information about an application amount of ink to be applied to a predetermined region on a recording medium based on image data to be recorded on the recording medium;

a movement unit configured to move the recording head and the recording medium in a predetermined direction relative to each other; and a determination unit configured to determine a moving speed for moving the recording head and the recording medium based on the application amount information, wherein the recording head discharges ink onto the recording medium to record the image, while the movement unit is moving the recording head and the recording medium relative to each other at the determined speed determined, and wherein, based on power information corresponding to a power amount used for driving the heating element, in a case of the power amount in a first amount, the determination unit determines, a first speed for the moving speed in a case where the application amount is equal to a predetermined amount and determines a speed higher than the first speed for the moving speed in a case where the application amount is smaller than the predetermined amount, and, in a case of the power amount in a second amount smaller than the first amount, the determination unit determines a speed higher than the first speed for the moving speed in a case where the application amount is equal to the predetermined amount.

2. The recording apparatus according to claim 1, wherein, in a case of the application amount larger than a threshold value, the determination unit determines a speed for moving speed lower than the moving speed in a case of the application amount equal to or smaller than the threshold value, and determines the moving speed based on the power information using a first threshold value in a case where the power amount is in the first amount, and based on the power information using a second threshold value larger than the first threshold value in a case where the power amount is in the second amount smaller than the first amount.

3. The recording apparatus according to claim 1, wherein, in the recording head, a plurality of discharge ports is disposed to cover a length for at least a maximum width of the corresponding recording medium in a direction intersecting with the predetermined direction, and wherein the movement unit conveys the recording medium in the predetermined direction.

4. The recording apparatus according to claim 1, wherein, in the recording head, a plurality of heating elements is disposed in the direction intersecting with the predetermined direction, wherein the heating element corresponding to the width of the recording medium out of the plurality of heating elements are driven, and wherein the power information is information related to the width of the recording medium in the intersecting direction.

5. The recording apparatus according to claim 1, wherein the recording head is capable of discharging ink of a plurality of colors, and includes a plurality of discharge ports for discharging ink of the respective colors, and the plurality of heating elements disposed corresponding to the plurality of discharge ports of the respective colors, wherein the recording apparatus includes a switching unit configured to switch among a plurality of modes having different combinations of colors to be used in recording, wherein the recording head drives the heating element corresponding to the discharge port for the colors to be used in a mode switched by the switching unit, and wherein information about the mode is used as the power information.

6. The recording apparatus according to claim 4, wherein the recording head discharges ink of a plurality of colors, and includes a plurality of discharge ports for discharging ink of the respective colors, and the plurality of heating elements disposed corresponding to the plurality of discharge ports of the respective colors, wherein the recording apparatus includes a switching unit configured to switch among a plurality of modes having different combinations of colors to be used in recording, wherein the recording head drives the heating element corresponding to the discharge port for the colors to be used in a mode switched by the switching unit, and wherein information about the mode is used as the power information.

7. The recording apparatus according to claim 1, wherein the power used to drive the heating element is variable, and wherein the power information is information about the power used to drive the heating element.

8. The recording apparatus according to claim 1, wherein in a case of the application amount equal to the predetermined amount, in a case where the power amount is in the second amount, the determination unit determines a second speed higher than the first speed for the moving speed, in a case where the power is in a third amount smaller than the second amount, the determination unit determines a third speed higher than the second speed for the moving speed.

9. The recording apparatus according to claim 1, wherein the application amount information is information indicating the amount of ink to be recorded per unit region.

10. The recording apparatus according to claim 1, wherein the recording element generates thermal energy using power.

11. The recording apparatus according to claim 1, wherein the heating element is disposed to correspond to a length of an intersecting direction of a discharge port array arranged in the intersecting direction where the discharge port intersects with the predetermined direction.

12. A recording method comprising;

recording an image by discharging ink from a recording head onto a recording medium while moving the recording head and the recording medium relative to each other at a determined moving speed, the recording head including a discharge port disposed on a substrate and configured to discharge ink, a recording element disposed corresponding to the discharge port and configured to generate energy for discharging ink using power, and a heating element disposed on the substrate as a different member from the recording element and configured to heat the substrate using power to adjust a temperature of ink before being discharged;

acquiring application amount information about an application amount of ink to be applied to a predetermined region on the recording medium based on image data to be recorded on the recording medium, and power information corresponding to power amount for driving the heating element; and determining, based on the application amount information and the power information, in a case of the power amount in a first amount, a first speed for the moving speed for relatively moving the recording head and the recording medium, in a case where the application amount is equal to a predetermined amount, and determining in a case of the power amount in a first amount a speed higher than the first speed in a case where the application amount is smaller than the predetermined amount, and, in a case of the power amount in a second amount smaller than the first amount, determining a speed higher than the first speed in a case where the application amount is equal to the predetermined amount.

* * * * *